US006450667B1

(12) United States Patent
Thompson

(10) Patent No.: US 6,450,667 B1
(45) **Date of Patent: *Sep. 17, 2002**

(54) LAMP AND REFLECTOR

(75) Inventor: Theodore Wade Thompson, White Rock, SC (US)

(73) Assignee: Earth Lighting Corporation, Columbia, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/659,805

(22) Filed: Sep. 11, 2000

Related U.S. Application Data

(63) Continuation-in-part of application No. 09/135,776, filed on Aug. 18, 1998, now Pat. No. 6,142,651.

(51) Int. Cl.[7] ..... F21K 7/00

(52) U.S. Cl. ..... 362/263; 362/217; 362/296; 362/359; 362/360; 362/361; 362/364; 362/404; 362/406; 362/416

(58) Field of Search ..... 362/217, 263, 362/261, 264, 404, 406, 416, 432, 296, 147, 364, 407, 408, 359, 360, 361; 313/25

(56) References Cited

U.S. PATENT DOCUMENTS 4,293,901 A 10/1981 Hernandez
4,947,292 A 8/1990 Vlah
5,016,150 A * 5/1991 Gordin et al. ..... 362/263
5,313,379 A 5/1994 Lemons et al.
5,329,438 A 7/1994 Thompson
5,586,015 A 12/1996 Baldwin et al.
6,142,651 A * 11/2000 Thompson ..... 362/263

* cited by examiner

*Primary Examiner*—Stephen Husar
*Assistant Examiner*—Bertrand Zeade
(74) *Attorney, Agent, or Firm*—Michael A Mann; Nexsen Pruet Jacobs & Pollard LLC

(57) ABSTRACT

A lighting system comprising a reflector and an arc lamp designed for illuminating a wide area with an even light distribution. The reflector has a cap that is generally parabolic in shape except perhaps at its top where it supports an arc lamp. The arc lamp is preferably a high intensity sodium or mercury vapor lamp with a vertical arc tube mounted so that the lowermost part of the arc tube is positioned to be even with the lowermost edge of the cap. The glass bulb housing the arc tube may extend below the lowermost edge. In an alternative embodiment, the lowermost edge of the cap has an extended portion and a short portion. In this embodiment, the lowermost part of the arc tube is even with the short portion.

5 Claims, 6 Drawing Sheets

HORIZONTAL ANGLE = 225.0
VERTICAL ANGLE = 65.1

HORIZONTAL ANGLE = 66.9
VERTICAL ANGLE = 67.5

LEGEND:
HORIZONTAL TRACE - SOLID LINE
VERTICAL TRACE - DASHED LINE

LAMP AND REFLECTOR

PRIORITY CLAIM

This application is a continuation in part of application Ser. No. 09/135,776, filed Aug. 18, 1998 now U.S. Pat. No. 6,142,651.

FIELD OF THE INVENTION

The present invention relates to outdoor or high bay illumination. In particular, the present invention relates to reflectors used with high intensity arc lamps.

BACKGROUND OF THE INVENTION

Lamps send out light in all directions. Without a shade or reflector, this light is only blocked by the base of the lamp. In order to make better use of this light, the lamps are used with reflectors and lenses. The reflectors reflect light emanating from one side of the lamp to another direction, and lenses refract the light so that it travels in a different and preferred direction when it passes from a lens than the direction it traveled when it entered the lens.

Light is a form of energy that should be conserved and not wasted. Light can also become a form of pollution if it is directed where it interferes with other activities, such as when light intended to illuminate the ground is partially directed into the sky only to obscure the stars. Control of a light beam is therefore important for three reasons, (1) light should be directed where it is needed so that it does what it is intended to do: illuminate an area, for example; (2) it should not be wasted by directing it where it serves no purpose; and (3) it should not be directed where it interferes with other activities.

Controlling light from lamps is not as simple as it might sound. Especially when using lamps to illuminate large areas of ground outside at night. The goal of outdoor illumination, generally speaking, is to spread light from a simple lamp over as wide an area as possible and as evenly as possible but not to allow any light to be directed upwardly or across grounds where it is not needed or desired.

For example, see the lighting optical system of Jones as described in U.S. Pat. No. 4,591,960 which is intended to uniformly illuminate a large area using multiple reflectors. FIG. 3 of Jones shows a candle power distribution curve achieved by his system. This type of curve is commonly used to compare the efficiencies of lighting systems.

Often light is directed upwardly at an object in such a way that little of the light actually reaches the object and much is directed into the sky where it serves no purpose or blocks the view of the stars. An example of this is illumination of flags. Meyer in U.S. Pat. No. 3,752,975 teaches a light at the top of a flag pole for illuminating the flag from above rather than below but his light does not provide the lateral range for illuminating an unfurled flag.

Parabolic reflectors are well known in illuminating systems, especially those where the light is to be directed downwardly. Parabolic reflectors by definition tend to keep light rays parallel when the lamp located at the focus of the parabola so that a parabolic reflector does not disperse light but tends to illuminate a small area. If the parabola is directed downwards and its edge is extended below the focus of the parabola and the lamp, it will prevent light from being directed upwardly. See for example, the device described by Thompson in U.S. Pat. No. 5,329,438.

Many lights use visors or reflectors that are less focused than that shown in Thompson's device to allow some spread of the light in a horizontal direction.

Nonetheless, there: remains a need for a reflector that better achieves the goal of an even, downward-only, wide-spread light pattern, especially for use outdoors and in high bays.

SUMMARY OF THE INVENTION

According to its major aspects and broadly stated, the present invention is a reflector having a parabolic cap in combination with a high intensity discharge lamp, in particular one with a vertically-oriented arc tube, placed so that the lowest point of the arc tube is approximately even with the bottom edge of the cap. In an alternative embodiment, a portion of the cap may extend below the lowest point of the arc tube. Under either embodiment, the glass bulb that encloses the arc tube will extend below at least a portion of the edge of the cap so that, when the present lamp reflector is viewed from the side, the bottom of the glass lamp will be visible but the arc tube in the glass lamp will be just eclipsed by the edge of the cap.

By forming a reflector having this shape and placing a lamp at the designated location, the distribution of light from the lamp is extraordinarily even and wide and light is not directed above the plane defined by the cap's edge.

The parabolic shape described herein is substantially parabolic; that is, one where the first portion of the cap, as measured from its center, may initially be flat but its shape is otherwise a true parabola through most of its length. The bottom of the arc tube should be no lower that the bottom of the cap.

A feature of the present invention is the combination of the position of the lamp with respect to the reflector and the reflector's shape. Because of this physical relationship, no light will be directed upwardly and much of the light will be directed laterally. The present reflector and lamp illuminate as wide an area as current prismatic lensed lamps with high efficiency but send no light upward; prismatic lamps send as much as 30%–35% of their light upward. Furthermore, there are no lenses to clean with the present invention.

Another feature of the invention is the use of a parabolic cap and an arc tube placed below the focus when the cap is in its normal orientation, namely, with a vertical axis and is downwardly-directed opening. By making the cap parabolic and locating the arc tube as described herein, light striking the inside of the cap toward its edge is reflected laterally to a greater extent than if the cap were a different shape.

Other features and advantages of the present invention will be apparent to those skilled in the art from a careful reading of the Detailed Description of a Preferred Embodiment presented below and accompanied by the drawings.

DETAILED DESCRIPTION OF PREFERRED EMBODIMENTS

Referring now to the figures, the present invention is a lamp and reflector combination for uniformly illuminating a wide area. The lamp may be any source of light including an incandescent light. However, most preferably, the lamp is a high intensity, high pressure sodium or mercury vapor, vertical lamp of 70–175 watts with an arc tube mounted so that the axis of the arc tube is parallel to the axis of the parabolic cap. These lamps throw most of their light to the side so, when oriented vertically, they illuminate a wide area. Several different embodiments are illustrated including those with visors and those without.

Figure 1:
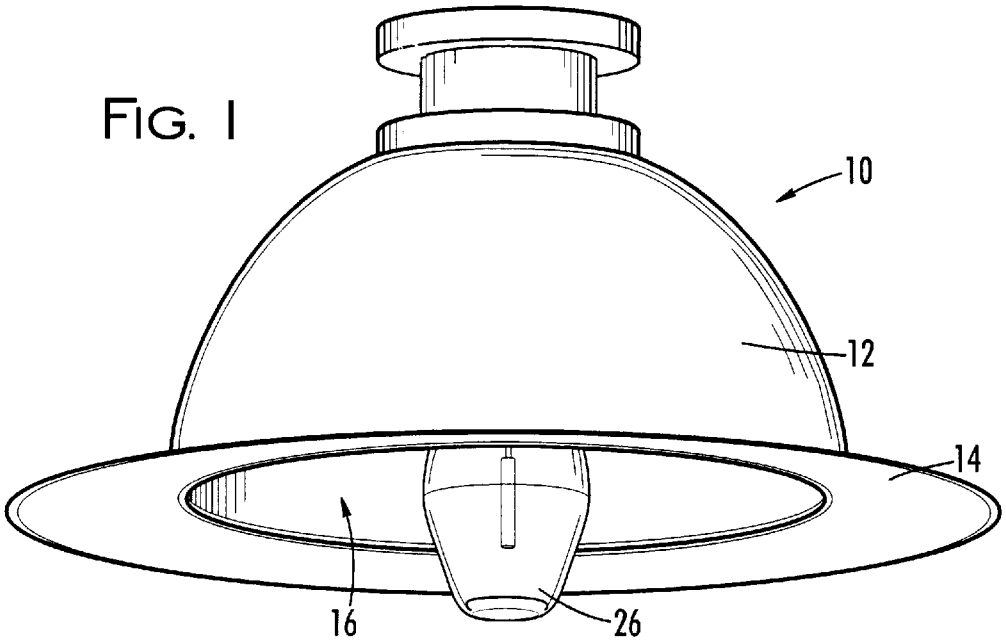
FIG. 1 is a perspective view of a reflector according to a preferred embodiment of the present invention.

The reflector, generally indicated in the figures by reference number 10, has a cap portion 12 and a visor portion 14 that are preferably integral, made of a reasonably rigid material that is opaque to the light of the lamp and its interior surface 16 is highly reflective of all wavelengths of visible light emitted by the lamp. For example, the reflector may be made of metal, glass or plastic and finished on its interior with a bright white or chrome finish or may be polished to a mirror-like condition. If the lamp is mounted from the bottom, the top of cap portion is closed; if the lamp is mounted from the top, as seen in FIG. 1, the top portion of cap portion is open.

The shape of cap 12 is defined in relation to its centerline 18. Beginning at its center 20 and moving radially outwardly from centerline 18, cap portion 12 is initially nearly flat or parabolic. It quickly begins to follow a parabolic shape until it reaches a junction 22 between cap portion 12 and visor portion 14 of cap 12. This shape will be referred to for convenience herein as a parabolic although the first portion of it may not be truly parabolic.

At junction 22, reflector 10 turns radially outwardly to form visor 14. Visor 14 is flat and oriented at a low angle 24. The extent of visor 14 depends on angle 24 and the position of lamp 26 mounted in it, as will be explained below. The bottom of visor 14 should be no higher than the bottom of arc tube 28. Angle 24 should be as small as practical and visor 14 must have a reasonably size such as three to six inches and will drop from juncture 22 by approximately one-half inch.

Figure 2:
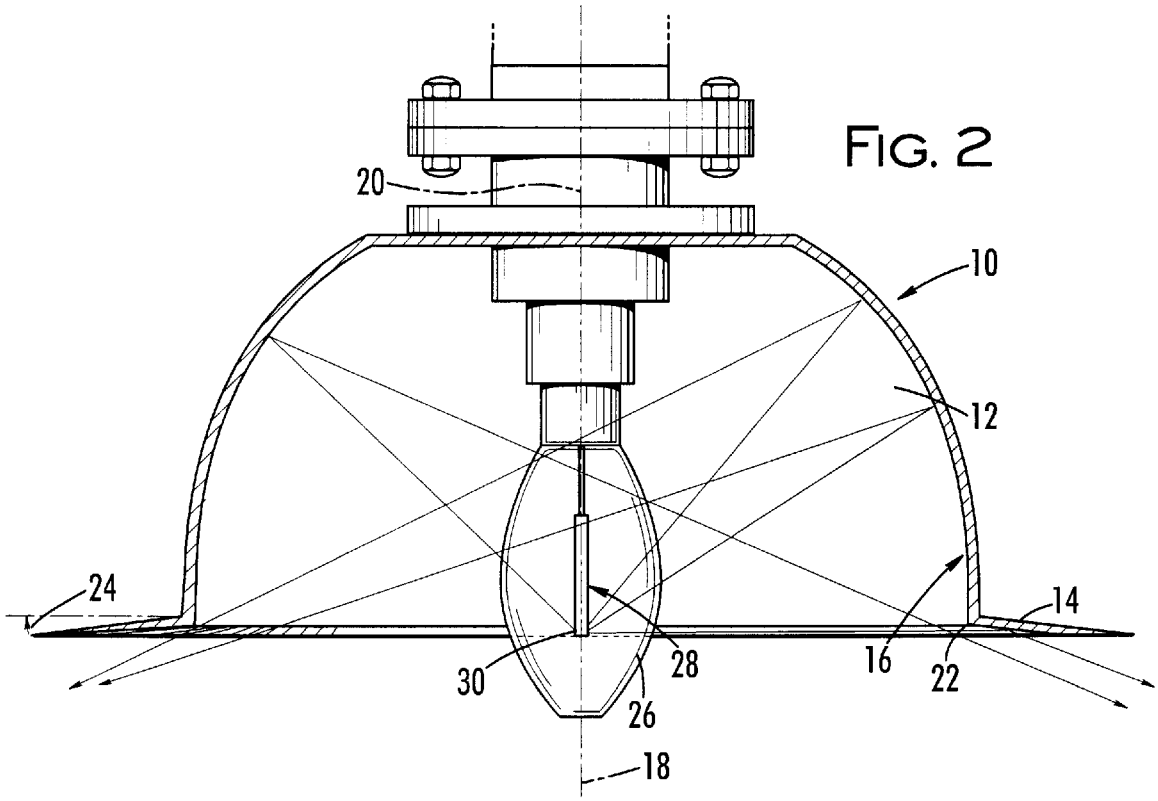
FIG. 2 is a cross sectional view of the reflector of FIG. 1.

Lamp 26 has an arc tube 28 mounted in it. Arc tube 28 has a length and a midpoint 30.Preferably, midpoint 30 is oriented so that it is even with the juncture 22 of cap 12 and visor 14; alternatively, no more than one-half inch of an arc tube 28 should extend below juncture 22. Any light from the upper half of arc tube 28 that is emitted by lamp 26 radially is cutoff by cap 12 and reflected ultimately downwardly and radially outwardly by cap 12. Any light from the lower half of arc tube 28 that is emitted by lamp radially is reflected downwardly and radially outwardly by visor 14 as shown in FIG. 2 by three light rays, one reflected essentially down, and one reflected radially by cap 12 and one, radially by visor 14.

Figure 3:
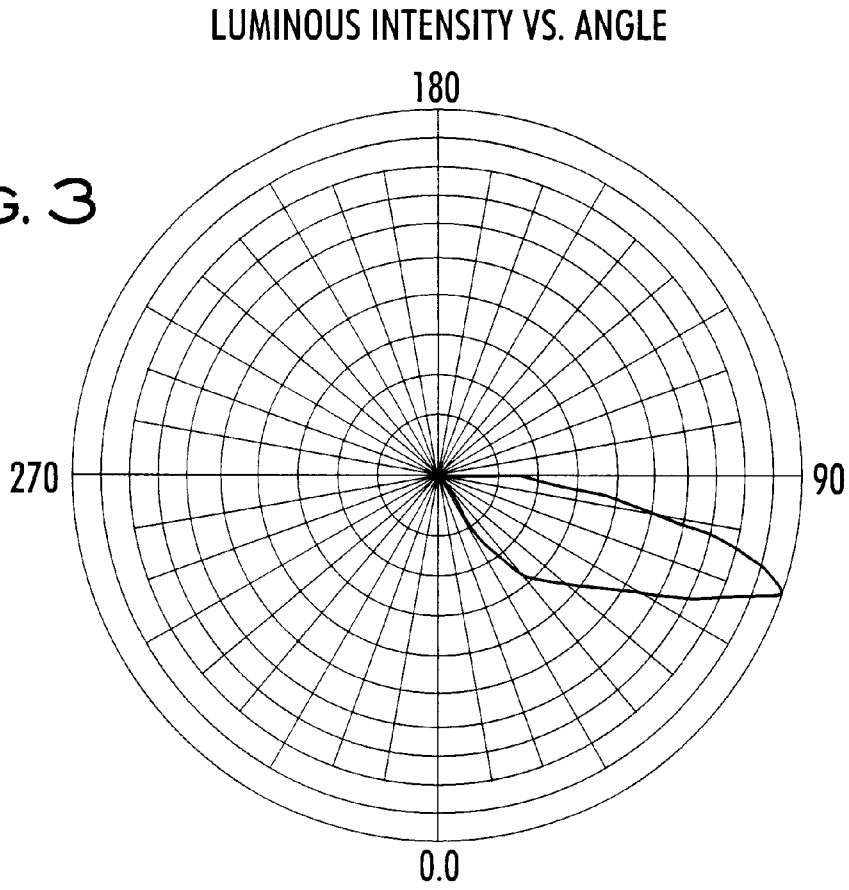
FIG. 3 is a candle power distribution curve for the present invention.

If one-half inch of arc tube 28 extends below juncture 22, then brim is preferably approximately 4½ inches in length. The lowermost part of arc tube 28 should not extend below visor 14. With a lamp and reflector according to the present invention and dimensions, a candle power distribution pattern such as that shown in FIG. 3 is obtained which illustrates a high efficiency of 86% or more.

A significant part of how this reflector works is that the arc tube is mounted low in the reflector so that all of the light from the bottom half inch of arc tube 28, which reflects off of cap 12, is reflected above the normal to send light out horizontally. There is a gradual change in the light reflections off the upper portion of cap 12 coming from arc tube 28. Regardless of the size of the lamp 26 used, the bottom half inch of its arc tube 28 would reflect light off the interior of cap 12 above the normal to that interior surface. The balance of arc tube 28 would reflect light off cap 12 below the normal as with current reflectors. Thus it makes no difference how long arc tube 28 is as long as the bottom of it is lined up with the bottom of visor 14 and approximately one-half inch of arc tube 28 is below cap 12.

Figure 4:
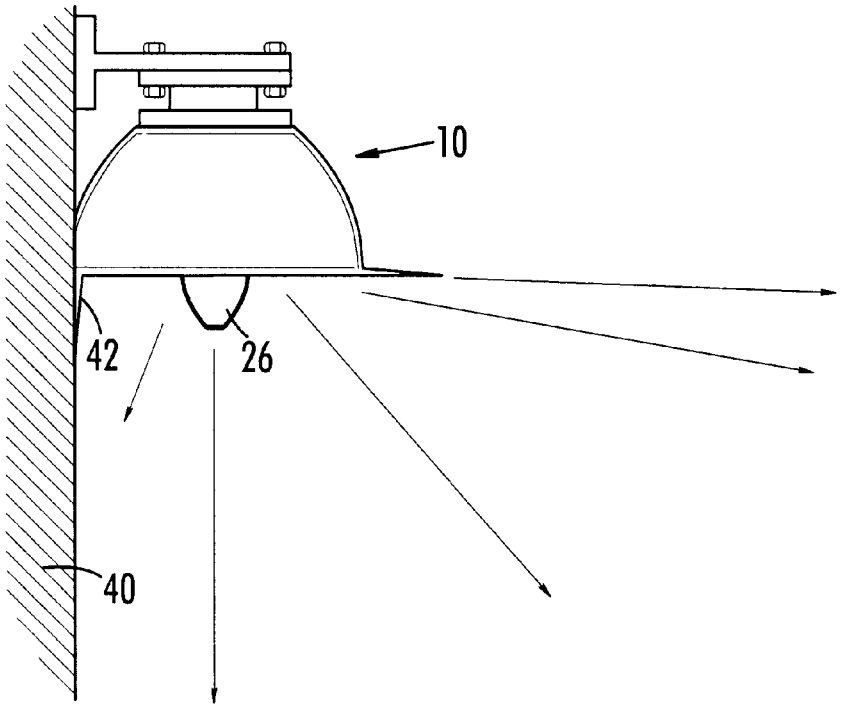
FIG. 4 is a perspective view of a first alternative embodiment of the present invention.

In an alternative embodiment shown in FIG. 4, a side of visor 14 is bent to form a fold 40 to reflect a portion of the light so that is redirected to the opposing side of lamp. This configuration would be used when reflector 10 is mounted to a wall 42. If mounted to a wall in a corner, reflector 10's visor 14 would have two folds meeting at right angles.

Figure 5A:
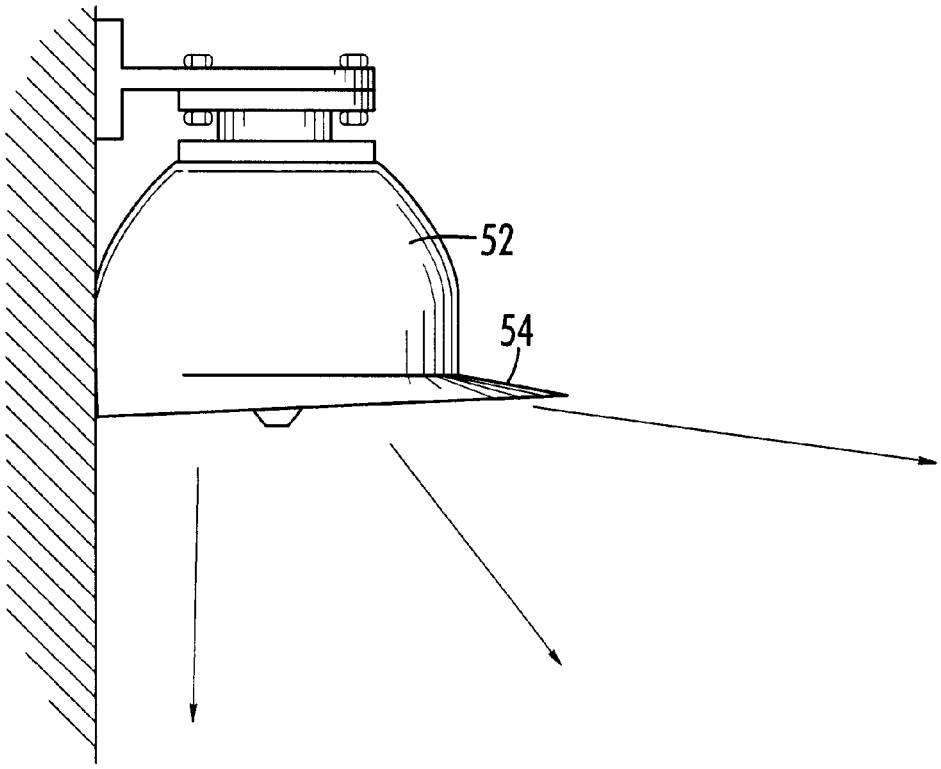
FIGS. 5A and 5B are top and side views, respectively of still another alternative embodiment of the present invention.
Figure 5B:
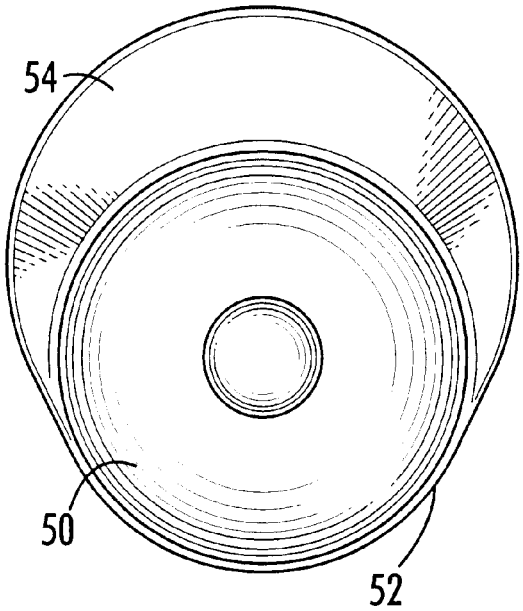

For use on a pole near a corner but not wall mounted, FIGS. 5A and 5B illustrate another embodiment of the present invention. A reflector 50 has a cap 52 and a visor 54 that extends outwardly as described above over a portion of the circumference of cap 52 but curves downwardly until, at the rearmost portion of the circumference, visor 54 is a continuation of cap 50's parabolic shape.

Figure 6:
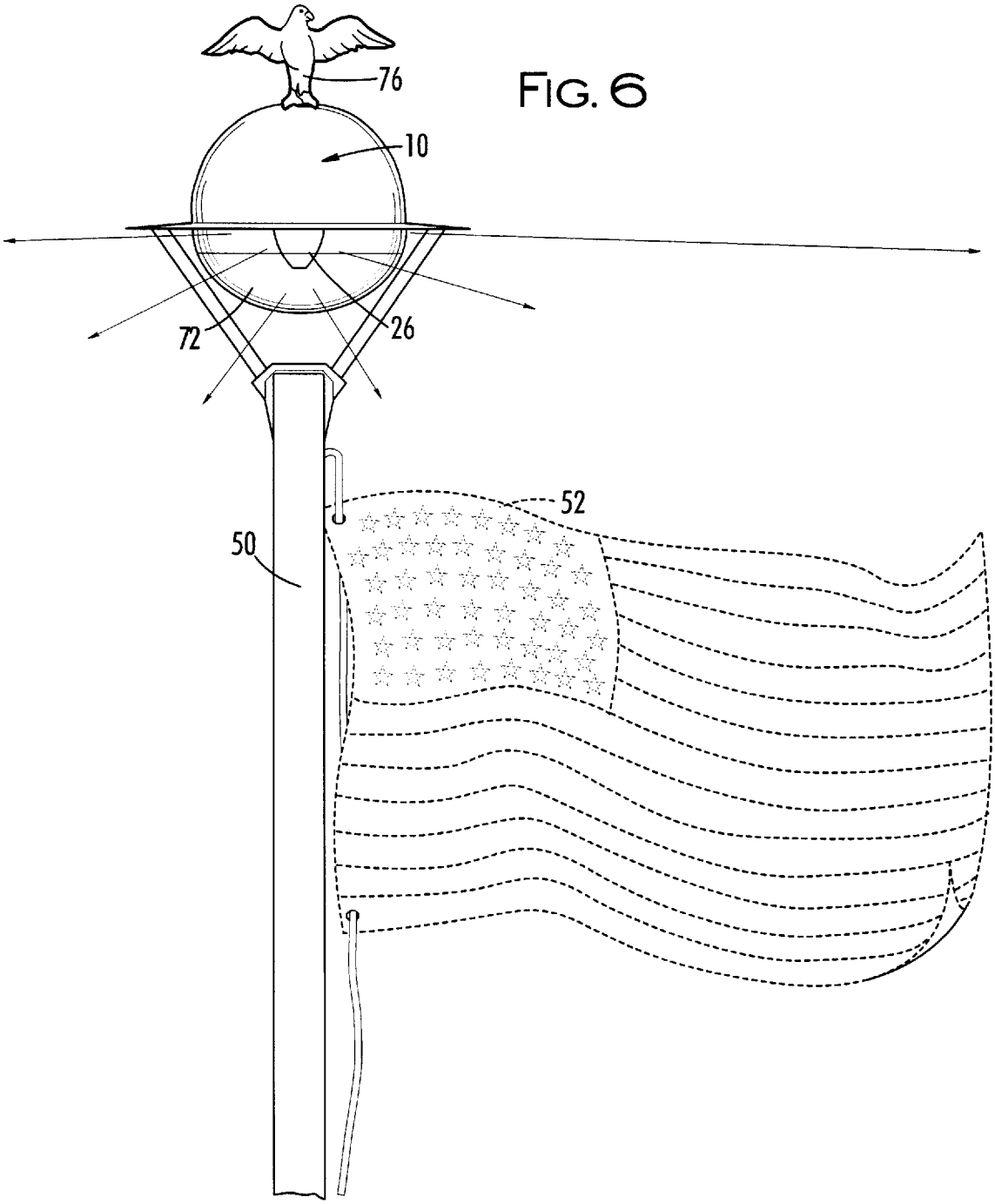
FIG. 6 is a perspective view of a second alternative embodiment of the present invention.

In still another alternative embodiment of the present invention shown in FIG. 6, a reflector 10 and lamp 26 according to the present invention are mounted to the top of a flagpole 50 to illuminate an unfurled flag 52, with no wasted light. An optional transparent cover 72 may be placed over lamp 26 and preferably, ornamentation, such as an eagle 76 may be placed on top of reflector 10.

Figure 7:
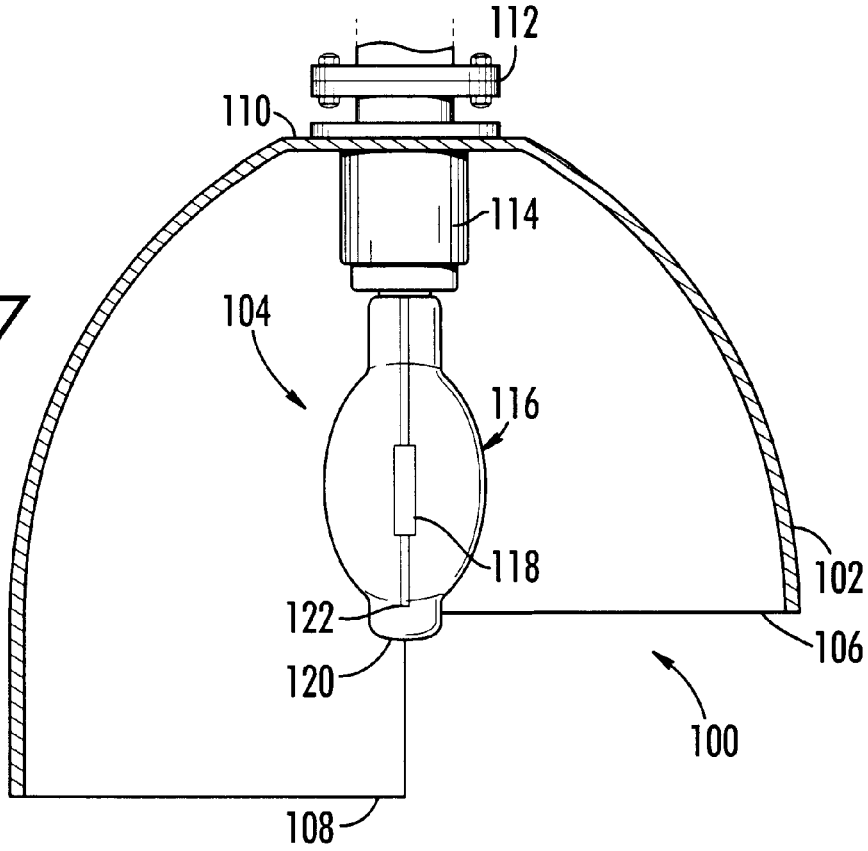
FIG. 7 is a side cross sectional view of a lamp reflector and lamp according to a third alternative embodiment of the present invention.

In FIG. 7, another embodiment of the present invention is illustrated. This lamp reflector, generally indicated by reference number 100, includes a cap 102 and an arc lamp 104. Cap 102 is has a short edge 106 and an extended edge 108. Overall, cap 102 is generally parabolic in shape except at the top 110 where it is flat and receives lamp 104, and near its extended edge 108 where it may approach the shape of a half cylinder.

This type of generally parabolic shape is typical of so called "high bay" reflectors, such as those made by Hubbell Lighting, Inc., except for extended edge 108. In the present invention, however, in addition to having extended edge 108 and short edge 106, the position of the arc tube with respect to the reflector cap is critical.

Lamp 104 includes a fitting 112, a base 114 attached to the fitting 112, and a lamp bulb 116. Inside bulb 116 is an arc tube 118. Arc tube 118 does not extend to the end 120 of bulb 116. The lowermost part 122 of arc tube 118 is even with short edge 106 of cap 102; bulb 116 extends slightly beyond short edge 106.

Extended edge 108 extends beyond bulb 116. Extended edge 108 is designed to direct a portion of light that would otherwise be directed laterally to one side so that it is reflected to the other side. Importantly, however, virtually all of the light emitted by arc tube 118 is directed either down or to one side; no significant light is directed upwardly.

Extended edge 108 prevents light from arc tube 116 from "trespassing" to the side of cap 102 it is on. Extended edge

108 preferably runs from 52 to 55 percent of the circumference of cap 102 and short edge 106 runs the remaining 45 to 48 percent of the circumference. Preferably in a 14½ inch high bay parabolic reflector, extended edge 108 is at least two inches and preferably approximately 2¼ inches longer than short edge 106.

Figure 8:
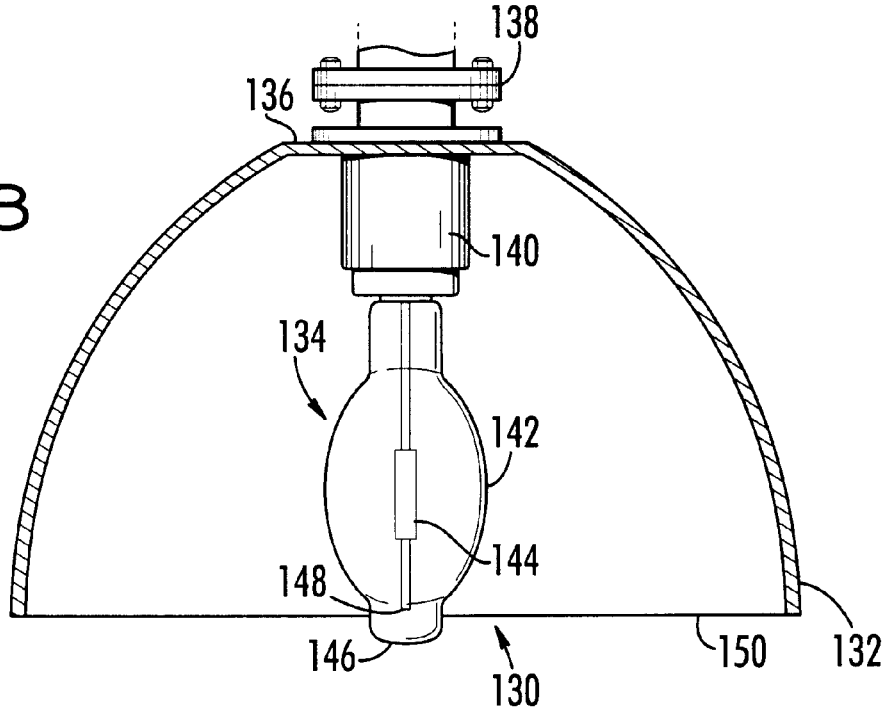
FIG. 8 is a side cross sectional view of a lamp reflector and lamp according to a fourth alternative embodiment of the present invention.

FIG. 8 illustrates another embodiment of the present invention similar to that illustrated in FIG. 7, except that there is no extended edge 108. Reflector lamp 130 includes a cap 132 and a lamp 134. Cap 132 is parabolic in shape except for a top 136 where it is flat and receives lamp 134.

As with the embodiment of FIG. 7, lamp 134 has a fitting 138, a base 140 and a lamp bulb 142 that houses an arc tube 144. The lowest part 148 of arc tube 144 extends just to a lowermost edge 150 of cap 132 and no farther. This location places arc tube 144 below the focus of the parabola defined by cap 132 and assures that light will be directed laterally as well as vertically but not in an upward direction (although a very small amount of light from arc tube 144 is reflected from the bottom 146 of lamp bulb 142 in a direction above the horizontal plane defined by lowermost edge 150.

Figure 9:
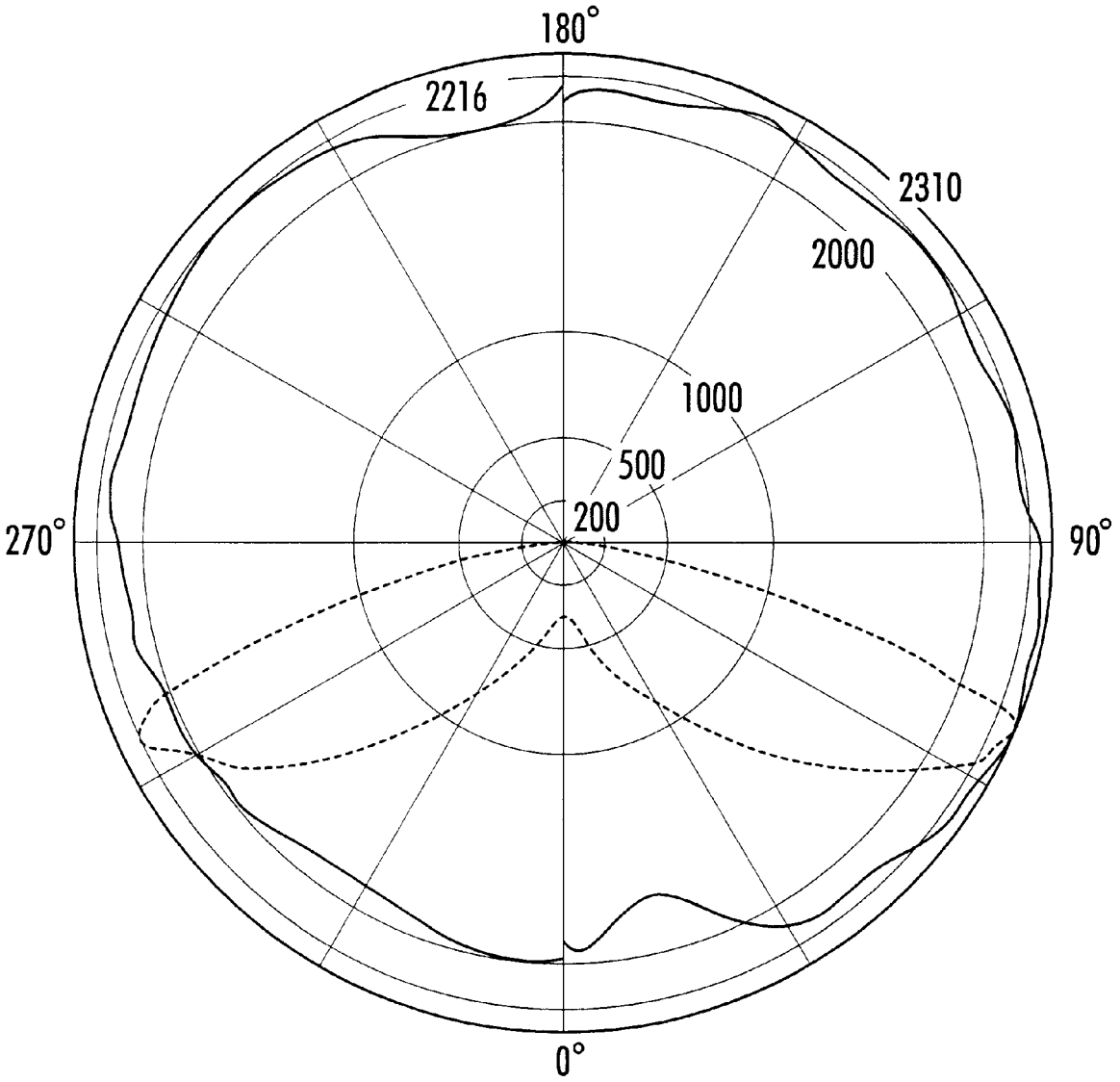
FIG. 9 is a chart showing the light dispersion pattern of a lamp reflector according to the preferred embodiment shown in FIG. 8.

The light dispersion pattern is charted in FIG. 9. This chart, in solid lines, shows a trace 150 the light dispersion evenly in all radial directions. A trace 152 in dashed lines shows the light dispersion in the vertical direction. Trace 152 shows how much light is scattered to the sides, where the light is as bright at an angle of approximately 66° from vertical as it is at about directly downward but at six times the distance. It must be noted that the light from the lamp is most useful when it is evenly distributed over a wide area below the light and not concentrated on a small area below it or directed in part up at the sky. The present lamp achieves significantly this goal.

It will be apparent to those skilled in the art that many changes and substitutions can be made to the preferred embodiment herein described without departing from the spirit and scope of the present invention as defined by the appended claims.

What is claimed is:

1. A device for illuminating an area, said device comprising:

a cap being substantially parabolic in shape and having a lowermost edge; and a lamp having an arc tube, said lamp being mounted within said cap so that the lowermost part of said arc tube is even with the lowermost edge of said cap.

2. The device as recited in claim 1, wherein said lamp is selected from the group consisting of high pressure sodium lamps and mercury vapor lamps.

3. A device for illuminating an area, said device comprising:

a cap being substantially parabolic in shape and having a lowermost edge, wherein said lowermost edge of said cap includes an extended edge and a short edge; and a lamp having an arc tube, said lamp being mounted within said cap so that the lowermost part of said arc tube is even with said short edge of said cap.

4. The device as recited in claim 3, wherein said short edge runs from 45% to 48% around the circumference of said cap.

5. The device as recited in claim 3, wherein said extended edge is at least two inches longer than said short edge.

* * * * *